US007816599B2

(12) United States Patent
Akazawa

(10) Patent No.: US 7,816,599 B2
(45) Date of Patent: Oct. 19, 2010

(54) TONE SYNTHESIS APPARATUS AND METHOD

(75) Inventor: Eiji Akazawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 155 days.

(21) Appl. No.: 12/302,500

(22) PCT Filed: May 25, 2007

(86) PCT No.: PCT/JP2007/060732

§ 371 (c)(1),
(2), (4) Date: Nov. 25, 2008

(87) PCT Pub. No.: WO2007/139034

PCT Pub. Date: Dec. 6, 2007

(65) Prior Publication Data

US 2009/0158919 A1 Jun. 25, 2009

(30) Foreign Application Priority Data

May 25, 2006 (JP) ..... 2006-144922

(51) Int. Cl.
*G10H 1/06* (2006.01)

(52) U.S. Cl. ..... 84/622; 84/604; 84/609; 84/618; 84/649; 84/659

(58) Field of Classification Search ..... None
See application file for complete search history.

(56) References Cited

U.S. PATENT DOCUMENTS 4,726,276 A 2/1988 Katoh et al.
5,262,582 A * 11/1993 Hanzawa et al. ..... 84/605

(Continued)

FOREIGN PATENT DOCUMENTS

EA 1653441 5/2006

(Continued)

OTHER PUBLICATIONS

International Preliminary Report on Patentability mailed Jan. 22, 2009, for PCT Application No. PCT/JP2007/060732, filed May 25, 2007, English Translation, five pages.

*Primary Examiner*—Marlon T Fletcher
(74) *Attorney, Agent, or Firm*—Morrison & Foerster LLP

(57) ABSTRACT

Either a tone generation priority mode or a quality priority mode can be set. If the currently-set mode is the tone generation priority mode when a connecting tone is to be generated for connecting between two successive notes, the joint-portion waveform data is selected for synthesis of the tone, stored head-portion waveform data and tail-portion waveform data are selected, and at least one of a pitch and amplitude of at least one of the head-portion waveform data and tail-portion waveform data is processed so as to provide a smoothly-varying connecting tone. In accordance with the processing, a tone of a fall portion of a temporally preceding one of two successive notes and a temporally succeeding one of the two successive notes are separately synthesized on the basis of the tail-portion waveform data and head-portion waveform data, respectively, so that a connecting tone is realized by a combination of the synthesized tone of the fall portion of the preceding note and the synthesized tone of the rise portion of the succeeding note.

11 Claims, 5 Drawing Sheets

U.S. PATENT DOCUMENTS

| | | | | |
|---|---|---|---|---|
| 5,610,353 | A | 3/1997 | Hagino | |
| 6,284,964 | B1 * | 9/2001 | Suzuki et al. | 84/626 |
| 6,365,817 | B1 * | 4/2002 | Suzuki et al. | 84/603 |
| 6,365,818 | B1 * | 4/2002 | Suzuki | 84/604 |
| 6,486,389 | B1 * | 11/2002 | Suzuki et al. | 84/603 |
| 6,531,652 | B1 * | 3/2003 | Suzuki et al. | 84/626 |
| 7,099,827 | B1 * | 8/2006 | Tamura | 704/270 |
| 7,102,068 | B2 * | 9/2006 | Kitayama | 84/607 |
| 7,420,113 | B2 * | 9/2008 | Ohno | 84/609 |
| 2002/0143545 | A1 | 10/2002 | Tamura et al. | |
| 2003/0084778 | A1 * | 5/2003 | Suzuki et al. | 84/604 |
| 2003/0177892 | A1 * | 9/2003 | Akazawa et al. | 84/616 |
| 2006/0090631 | A1 | 5/2006 | Ohno | |

FOREIGN PATENT DOCUMENTS

| | | |
|---|---|---|
| EP | 1258864 | 11/2002 |
| JP | 62-003298 | 1/1987 |
| JP | 06-149261 | 5/1994 |
| JP | 07-334156 | 12/1995 |
| JP | 2002-287759 | 10/2002 |
| JP | 2004-045455 | 2/2004 |
| JP | 2006-126710 | 5/2006 |

* cited by examiner

TONE SYNTHESIS APPARATUS AND METHOD

CROSS-REFERENCE TO RELATED APPLICATIONS

This application is a United States National Stage Application under 35 U.S.C. §371 of International Patent Application No. PCT/JP2007/060732, filed 25 May 2007, which claims the benefit to Japanese Patent Application No. 2006-144922, filed 25 May 2006, each of which is incorporated by reference into this application as if fully set forth herein.

TECHNICAL FIELD

The present invention relates generally to tone synthesis apparatus and programs for synthesizing tones, voices or other desired sounds on the basis of waveform sample data stored in a waveform memory or the like. More particularly, the present invention relates to an improved tone synthesis apparatus and method for, at the time of continuously connecting between adjoining or successive notes with no discontinuity or break of tone therebetween, synthesizing successive tones without involving an auditory tone generating delay of a succeeding one of the notes.

BACKGROUND ART

Heretofore, the so-called AEM (Articulation Element Modeling) technique has been known as a technique for facilitating realistic reproduction and reproduction control of various rendition styles (or various types of articulation) to natural musical instruments, and it has been conventional to synthesize high-quality tone waveforms using the AEM technique. As known in the art, the AEM technique can generate a continuous tone waveform with high quality by time-serially combining a plurality of ones of rendition style modules corresponding to various portions of tones, such as head-type or head-portion rendition style modules each representative of a rise (i.e., head or attack) portion of a tone, body-portion rendition style modules each representative of a steady portion (or body portion) of a tone, tail-portion modules each representative of a fall (i.e., tail or release) portion and joint-portion rendition style modules each representative of a connecting portion or joint portion for continuously connecting between successive notes (or note portions) with no break of tone therebetween using a desired rendition style like a legato rendition style. One example of tone synthesis using the AEM technique is disclosed in Japanese Patent Application Laid-open Publication No. 2002-287759. Note that, throughout this specification, the terms "tone waveform" are used to mean a waveform of a voice or any desired sound rather than being limited only to a waveform of a musical tone. Further, in each joint-portion rendition style module, waveform data of a former-half module portion where a tone pitch of a first (i.e., preceding) note can be heard mainly as compared to a tone pitch of a second (i.e., succeeding) note will hereinafter be referred to as "pre-note portion", and waveform data a latter-half module portion following the former-half module portion (i.e., module portion following a predetermined shift point where a human player starts to auditorily perceive that sounding of the succeeding note has started with a shift from the tone pitch of the preceding note to the tone pitch of the succeeding note) will hereinafter be referred to as "post-note portion".

In synthesis of a connecting tone of a joint portion using the above-mentioned joint-portion rendition style module in a real-time performance where tones are sequentially synthesized in response to performance operation by a human player, there may sometimes be caused an auditory tone-generating delay (also called "latency") from a note-on instruction of a succeeding note to a time point when sounding of the succeeding note can start to be heard. This is, for example, due to some characteristics specific to the joint-type or joint-portion rendition style module that (1) a considerable time is required for operations to permit a smooth tone pitch connection and shift from the currently-sounded preceding note to the succeeding note to be sounded next, such as operations for adjusting a tone pitch, amplification, etc. of the joint-portion rendition style module in accordance with respective rendition style modules of the adjoining preceding and succeeding notes and (2) the time required for the tone pitch shift from the currently-sounded preceding note to the succeeding note (i.e., this time corresponds to a time length from the start of synthesis of a tone of the pre-note portion to the start of synthesis of a tone of the post-note portion) depends on the tone pitch of the preceding note, type of a musical instrument, performance style, etc. Thus, even where the human player wants to execute a performance with priority given to tone generation timing of the succeeding note (i.e., without causing a latency) at the sacrifice of tone quality, it has heretofore been difficult to execute such a performance due to the characteristics specific to the joint-portion rendition style module. As an alternative approach, it is conceivable to synthesize a tone using a tail-portion rendition style module for the preceding note and a head-portion rendition style module for the succeeding note without using a joint-portion rendition style module. With such an alternative approach, however, a feeling of connection between the preceding and succeeding notes would be undesirably lost. Thus, there has been a demand for an improved technique, which in a case where a tone of a joint portion for connecting between adjoining or successive notes is to be synthesized, not only can synthesize a tone with the tone quality given priority over the tone generation timing of the succeeding note as in the past but also can synthesize a tone with the tone generation timing of the succeeding note given priority over the tone quality, and which can synthesize a tone with minimized degradation of the tone quality even in the case where priority is given to the tone generation timing. But, to date, no such technique has been proposed or developed.

DISCLOSURE OF THE INVENTION

In view of the foregoing, it is an object of the present invention to provide an improved tone synthesis apparatus and method which, in synthesis of a connecting tone between adjoining notes, can shift, in response to selecting operation by a human player, between a mode for synthesizing high-quality tones faithfully representing tone color variation and a mode for synthesizing tones without involving an undesired auditory tone generating delay and thus can synthesize tones of good quality.

In order to accomplish the above-mentioned object, the present invention provides an improved tone synthesis apparatus, which comprises: a storage section that stores therein at least head-portion waveform data corresponding to a rise portion of a tone, tail-portion waveform data corresponding to a fall portion of a tone and joint-portion waveform data corresponding to a joint portion connecting between two successive notes; a mode setting section that sets either one of a tone generation priority mode and a quality priority mode; an acquisition section that acquires performance information; a data selection section that, when a connecting tone for connecting between two successive notes is to be generated in accordance with the acquired performance information, selects the joint-portion waveform data from the storage section if a mode currently set by the mode setting section is the quality priority mode, but selects the head-portion waveform data and the tail-portion waveform data from the storage section if the currently-set mode is the tone generation priority mode; a data processing section that, when the currently-set mode is the tone generation priority mode, processes at least one of a pitch and amplitude of at least one of the head-portion waveform data and tail-portion waveform data selected by the data selection section, on the basis of the acquired performance information, so as to provide a smoothly-varying connecting tone; and a tone synthesis section that synthesizes a tone on the basis of the waveform data read out from the storage section in response to selection by the data selection section and in accordance with processing by the data processing section. When the currently-set mode is the tone generation priority mode, the tone synthesis section separately synthesizes, in accordance with the processing by the data processing section, a tone of a fall portion of a temporally preceding one of two successive notes on the basis of the tail-portion waveform data read out from the storage section and a tone of a rise portion of a temporally succeeding one of the two successive notes on the basis of the head-portion waveform data read out from the storage section, so that a connecting tone is realized by a combination of the synthesized tone of the fall portion of the preceding note and the synthesized tone of the rise portion of the succeeding note.

According to the present invention, when a connecting tone for connecting between two successive notes is to be generated in accordance with acquired performance information, either the tone generation priority mode or the quality priority mode can be set. If the currently-set mode is the quality priority mode, the joint-portion waveform data is selected for synthesis of the connecting tone, while, if the currently-set mode is the tone generation priority mode, the head-portion waveform data and the tail-portion waveform data are selected for synthesis of the connecting tone. The joint-portion waveform data is data corresponding to a joint portion connecting between two successive notes, the head-portion waveform data is data corresponding to a rise portion of a tone, and the tail-portion waveform data is data corresponding to a fall portion of a tone. In the tone generation priority mode, the tone synthesis section reads out designated head-portion waveform data and tail-portion waveform data from the storage section, and then it separately synthesizes, in accordance with the waveform processing by the processing section, a tone of a fall portion of a temporally preceding one of two successive notes on the basis of the read-out tail-portion waveform data and a tone of a rise portion of a temporally succeeding one of the two successive notes on the basis of the read-out head-portion waveform data. Pitch and/or amplitude of the head-portion waveform data and tail-portion waveform data is processed, so as to provide a smoothly-varying connecting tone. Thus, in the tone generation priority mode, where tones of the tail-portion waveform data and head-portion waveform data are synthesized simultaneously in a parallel fashion, there is no need to make fine waveform level adjustment of the two waveform data; there is only a need to process at least one of the pitch and amplitude so that the two can vary smoothly. Therefore, in the joint portion for connecting between two successive notes with no break of tone, the tone generation priority mode does not require a long time for system calculations to connect the succeeding note to the currently-sounded preceding note and for tone pitch variation, as compared to the quality priority mode (in which joint-portion waveform data is used), so that there would be caused no auditory tone generating delay (latency). Further, even if tones of the preceding and succeeding notes are synthesized separately, the present invention can synthesize, with high quality, a tone of a legato rendition style or the like that smoothly vary as connecting tones.

Thus, in synthesizing a tone of a joint portion connecting between at least two notes to be sounded in succession, the present invention allows a human player to select whether priority should be given to the tone quality (quality priority mode) or to the tone generation timing of the succeeding note (tone generation priority mode). Further, even in the case where priority is given to the tone generation timing of the succeeding note, the present invention can advantageously synthesize tones of a legato rendition style or the like without greatly degrading the tone quality.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

BRIEF DESCRIPTION OF THE DRAWINGS

For better understanding of the objects and other features of the present invention, its preferred embodiments will be described hereinbelow in greater detail with reference to the accompanying drawings, in which.

BEST MODE FOR CARRYING OUT THE INVENTION

Figure 1:
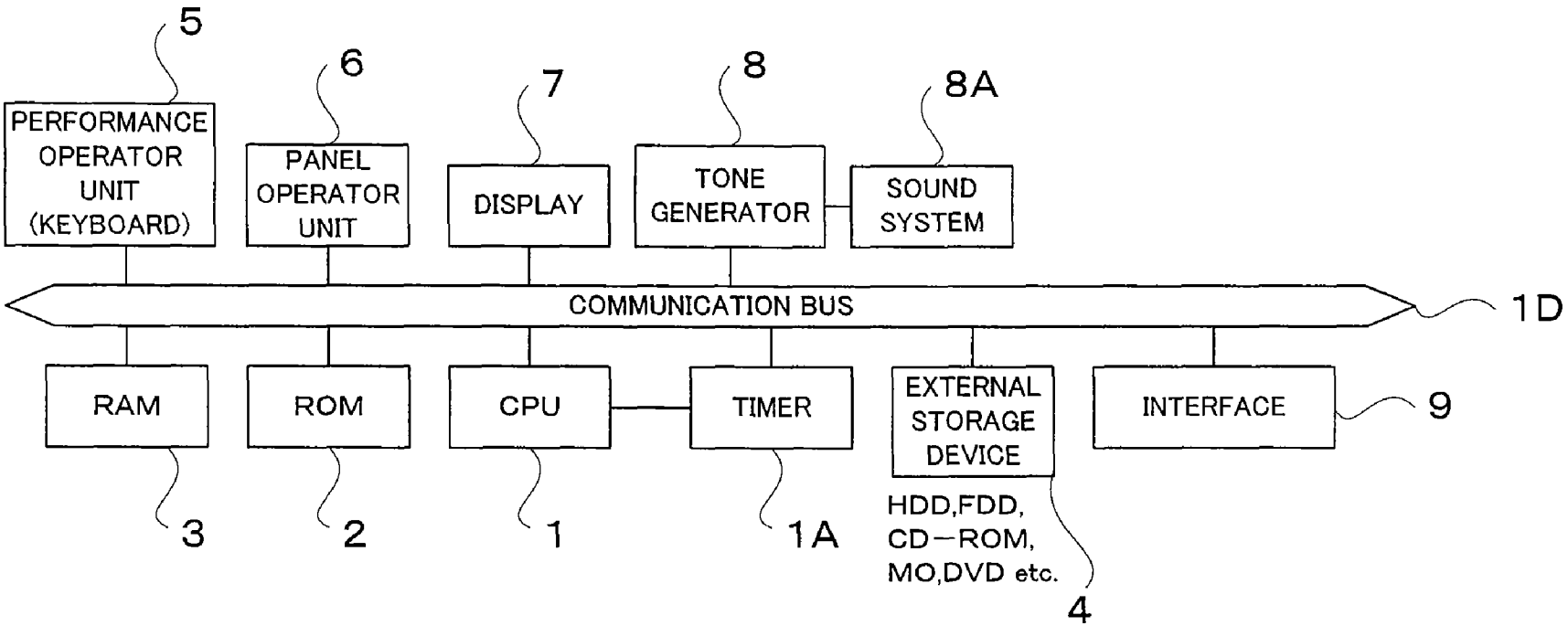
FIG. 1 is a block diagram showing an example general hardware setup of an electronic musical instrument to which is applied a tone synthesis apparatus in accordance with an embodiment of the present invention.

FIG. 1 is a block diagram showing an exemplary general hardware setup of an electronic musical instrument to which is applied a tone synthesis apparatus in accordance with an embodiment of the present invention. The electronic musical instrument illustrated here has a tone synthesis function for electronically generating tones on the basis of performance information (e.g., performance event data, such as note-on information and note-off information, and various control data, such as dynamics information and pitch information) supplied in real time in response to actual performance operation, by a human player, on a performance operator unit 5, and for automatically generating tones while performing, for example, pre-reading of data based on pre-created performance information sequentially supplied in accordance with a performance progression. Further, during execution of the above-mentioned tone synthesis function, the tone synthesis apparatus of the invention selects, for a joint portion where two successive notes are continuously interconnected with no break of tone therebetween, waveform sample data (hereinafter referred to simply as "waveform data") to be used on the basis of performance information and mode setting information and synthesizes a tone in accordance with the selected waveform data. In the aforementioned manner, the instant embodiment of the invention allows tones of a legato rendition style or the like to be reproduced with high quality without involving an undesired auditory tone generating delay (latency). Such tone synthesis for the connecting or joint portion will be later described in detail.

Although the electronic musical instrument employing the embodiment of the tone synthesis apparatus to be detailed below may include other hardware than those described here, it will hereinafter be explained in relation to a case where only necessary minimum resources are used. Further, the electronic musical instrument will be described hereinbelow as employing a tone generator that uses a conventionally-known tone waveform control technique called "AEM (Articulation Element Modeling)" (so-called "AEM tone generator"). The AEM technique is intended to perform realistic reproduction and reproduction control of various rendition styles etc. faithfully expressing tone color variation based on various rendition styles or various types of articulation specific to various natural musical instruments, by prestoring, as sets of waveform data corresponding to rendition styles specific to various musical instruments, entire waveforms corresponding to various rendition styles (hereinafter referred to as "rendition style modules") in partial sections or portions, such as a head portion, tail portion, body portion, etc. of each individual tone or note or in connecting or joint portions between two successive notes and then time-serially combining a plurality of the prestored rendition style modules to thereby form a tone of one or more successive notes.

Figure 4:
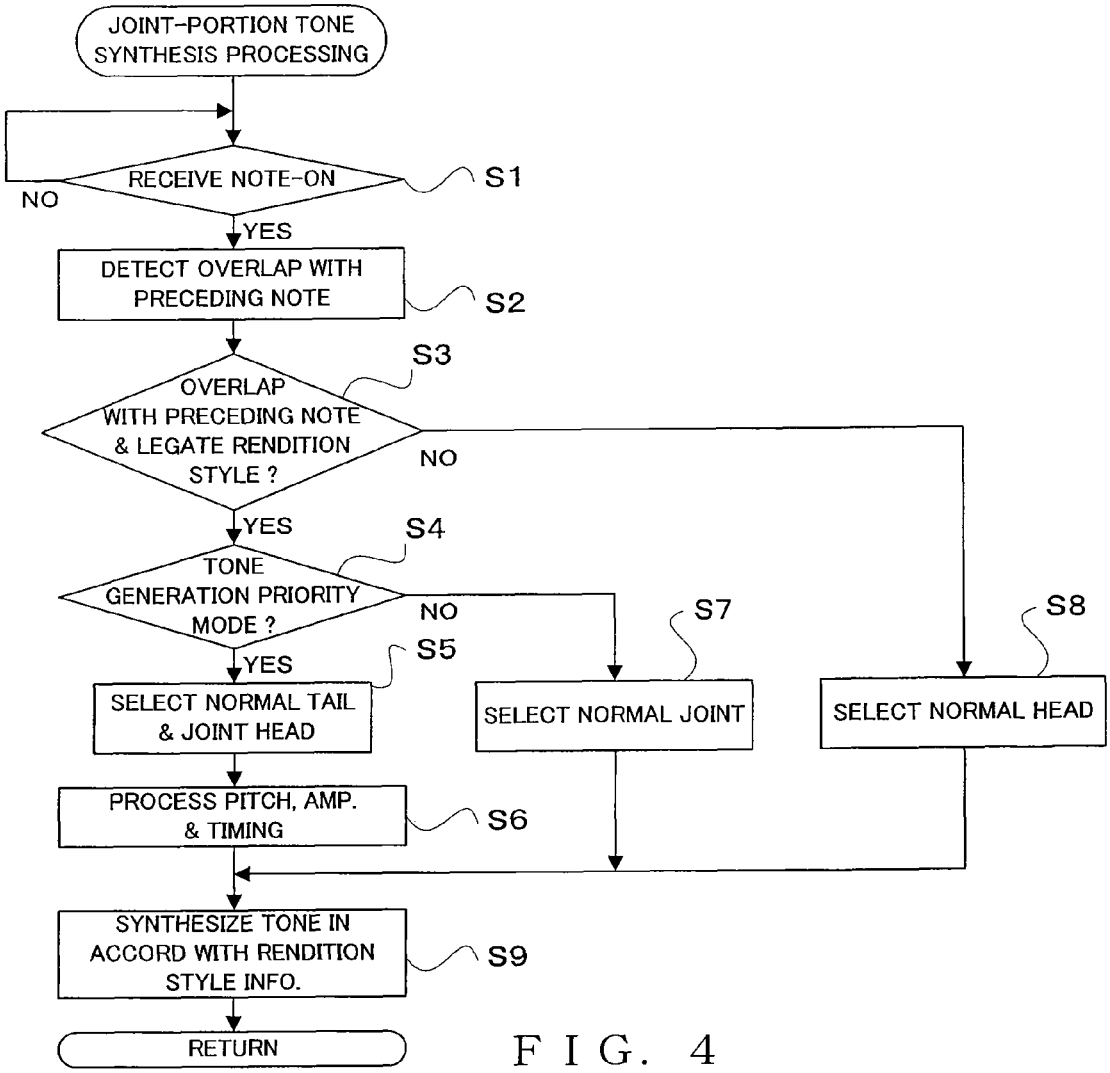
FIG. 4 is a flow chart showing an example of joint-portion tone synthesis processing.

The electronic musical instrument shown in FIG. 1 is implemented using a computer, where various "tone synthesis processing" for realizing the above-mentioned tone synthesis function is carried out by the computer executing respective predetermined programs (software); however, only processing pertaining to tone synthesis of a joint portion will be later explained here with primary reference to FIG. 4). Of course, these processing may be implemented by microprograms to be executed by a DSP (Digital Signal Processor), rather than by such computer software. Alternatively, the processing may be implemented by a dedicated hardware apparatus having discrete circuits or integrated or large-scale integrated circuit incorporated therein.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer 1A for counting various times, such as ones to signal interrupt timing for timer interrupt processes. Namely, the timer 1A generates tempo clock pulses for counting a time interval or setting a performance tempo with which to automatically perform a music piece in accordance with predetermined performance information. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions.

The ROM 2 stores therein various programs to be executed by the CPU 1 and also stores therein, as a waveform memory, various data, such as waveform data (indicative of, for example, waveforms having tone color variation based on a legato rendition style and the like, waveforms having straight tone colors, etc.). The RAM 3 is used as a working memory for temporarily storing various data generated as the CPU 1 executes predetermined programs, and as a memory for storing a currently-executed program and data related to the currently-executed program. Predetermined address regions of the RAM 3 are allocated to various functions and used as various registers, flags, tables, memories, etc. The external storage device 4 is provided for storing various data, such as performance information to be used as bases of automatic performances and waveform data corresponding to rendition styles, and various control programs, such as "joint-portion tone synthesis processing" (see FIG. 4), to be executed or referred to by the CPU 1. Where a particular control program is not prestored in the ROM 2, the control program may be stored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may comprise any of various removable-type external recording media other than the hard disk (HD), such as a flexible disk (FD), compact disk (CD-ROM or CD-RAM), magneto-optical disk (MO) and digital versatile disk (DVD). Alternatively, the external storage device 4 may comprise a semiconductor memory.

The performance operator unit 5 is, for example, in the form of a keyboard including a plurality of keys operable to select pitches of tones to be generated and key switches provided in corresponding relation to the keys. This performance operator unit 5 can be used not only for a manual performance based on manual playing operation by the human player, but also as input means for selecting desired prestored performance information to be automatically performed. It should be obvious that the performance operator unit 5 may be of any other type than the keyboard type, such as a neck-like operator unit having tone-pitch-selecting strings provided thereon. The panel operator unit 6 includes various operators, such as performance information selecting switches for selecting desired performance information to be automatically performed, mode selection switches for selecting a "quality priority mode" for synthesizing high-quality tones faithfully representing or expressing tone color variation and a "tone generation priority mode" for synthesizing tones without involving an undesired auditory tone generating delay, etc. Needless to say, the panel operator unit 6 may also include a numeric keypad for inputting numerical value data to be used for selecting, setting and controlling tone pitches, colors, effects, etc. to be used, a keyboard for inputting text, letter or character data, a mouse for operating a pointer to designate a desired position on any of various screens displayed on the display device 7, and various other operators. For example, the display device 7 comprises a liquid crystal display (LCD), CRT (Cathode Ray Tube) and/or the like, which visually displays not only various screens in response to operation of the corresponding switches but also various information, such as performance information and waveform data, and controlling states of the CPU 1. The human player can readily set various performance parameters to be used for a performance, set a mode and select a music piece to be automatically performed, with reference to the various information displayed on the display device 7.

The tone generator 8, which is capable of simultaneously generating tone signals in a plurality of tone generation channels, receives performance information supplied via the communication bus 1D and synthesizes tones and generates tone signals on the basis of the received performance information. Namely, as waveform data corresponding to performance information are read out from the ROM 2 or external storage device 4, the read-out waveform data are delivered via the bus 1D to the tone generator 8 and buffered as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone the digital processing are then supplied to a sound system 8A for audible reproduction or sounding.

The interface 9, which is, for example, a MIDI interface or communication interface, is provided for communicating various information between the electronic musical instrument and external performance information generating equipment (not shown). The MIDI interface functions to supply or input performance information of the MIDI standard from the external performance information generating equipment (in this case, other MIDI equipment or the like) to the electronic musical instrument and output performance information of the MIDI standard from the electronic musical instrument to other MIDI equipment or the like. The other MIDI equipment may be of any desired type (or operating type), such as the keyboard type, guitar type, wind instrument type, percussion instrument type or gesture type, as long as it can generate data of the MIDI format in response to operation by a user of the other MIDI equipment. The communication interface is connected to a wired or wireless communication network (not shown), such as a LAN, Internet and/or telephone line network, via which the communication interface is connected to the external performance information generating equipment (e.g., server computer). Thus, the communication interface functions to input various information, such as a control program and performance information, from the server computer to the electronic musical instrument. Namely, the communication interface is used to download particular information, such as a particular control program or performance information, from the server computer in a case where such particular information is not stored in the ROM 2, external storage device 4 or the like. In such a case, the electronic musical instrument, which is a "client", sends a command to request the server computer to download the particular information by way of the communication interface and communication network. In response to the command from the client, the server computer delivers the requested information to the electronic musical instrument via the communication network. The electronic musical instrument receives the particular information via the communication interface and stores it into the external storage device 4 or the like. In this way, the necessary downloading of the particular information is completed.

Note that, in the case where the interface 9 is in the form of a MIDI interface, the MIDI interface may be implemented by a general-purpose interface rather than a dedicated MIDI interface, such as RS232-C, USB (Universal Serial Bus) or IEEE1394, in which case other data than MIDI data may be communicated at the same time. In the case where such a general-purpose interface as noted above is used as the MIDI interface, the other MIDI equipment connected with the electronic musical instrument may be designed to communicate other data than MIDI data. Of course, the performance information handled in the present invention may be of any other data format than the MIDI format, in which case the MIDI interface and other MIDI equipment are constructed in conformity to the data format used.

Figure 2:
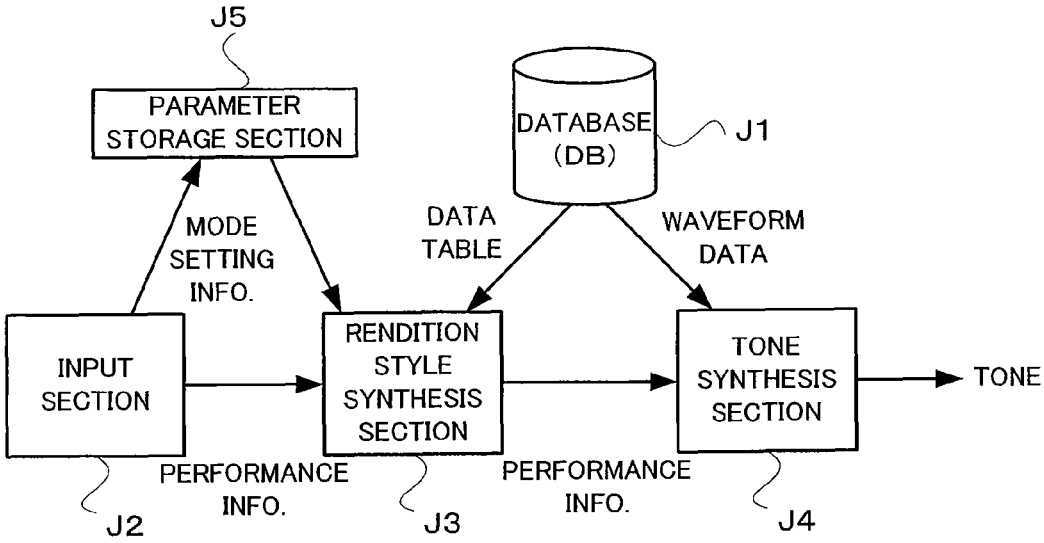
FIG. 2 is a functional block diagram explanatory of a tone synthesis function.

The electronic musical instrument shown in FIG. 1 is equipped with the tone synthesis function capable of successively generating tones on the basis of performance information generated in response to operation, by the human operator, of the performance operator unit 5 or performance information of the SMF (Standard MIDI File) format or the like prepared in advance (i.e., performance information stored in the ROM 2 or external storage device 4, or performance information input via the interface). Also, during execution of the tone synthesis function, the electronic musical instrument selects waveform data, which are to be newly used for each tone portion, on the basis of performance information supplied sequentially in real time in accordance with a performance progression based on operation, by the human operator, of the performance operator unit 5 or performance information supplied sequentially from a sequencer (not shown) or the like time, based for example on pre-reading, in accordance with a performance progression, and then it synthesizes a tone in accordance with the selected waveform data. So, the following paragraphs outline the tone synthesis function of the electronic musical instrument, with reference to FIG. 2. FIG. 2 is a functional block diagram explanatory of the tone synthesis function of the electronic musical instrument, where arrows indicate flows of data. Note that an input section (performance information acquisition section) J2 is constructed here by a mechanism for detecting human player's operation of the performance operator unit 5 in the electronic musical instrument and a sequencer function (i.e., function for reading out performance information from the ROM 2 or external storage device 4 and automatically performing the read-out performance information) contained in the electronic musical instrument, or a function for receiving, via the interface 9, performance information supplied in response to execution of an automatic performance by an external sequencer.

Once the execution of the tone synthesis function is started, performance information is sequentially supplied from the input section J2 to a rendition style synthesis section J3. The input section J2 includes the performance operator unit 5 that generates performance information in response to performance operation by the human operator, and other input devices, such as the sequencer that supplies, in accordance with a performance progression, performance information prestored in the ROM 2 or the like. The performance information supplied from the input section J2 includes at least performance event data, such as note-on information and note-off information (these information will hereinafter be generically referred to as "note information"), and control data, such as dynamics information and pitch information. Upon receipt of the performance event data, control data, etc., the rendition style synthesis section J3 generates "rendition style information", including various information necessary for tone synthesis, by, for example, identifying a head portion and joint portion on the basis of the note-on information, identifying a tail portion on the basis of the note-off information and converting the received control data. More specifically, the rendition style synthesis section J3 refers to a data table, provided in a database J1 (waveform memory), etc. to select a rendition style module corresponding to the input dynamics information and pitch information and then adds, to the corresponding "rendition style information", information indicative of the selected rendition style module.

When selecting a rendition style module to be applied to a joint portion, the rendition style synthesis section J3 refers to mode setting information stored in a parameter storage section J5. The mode setting information stored in the parameter storage section J5 is information for setting either the "tone generation priority mode" giving priority given to tone generation timing of a succeeding note, or the "quality priority mode" giving priority to tone quality. Such mode setting information can be set by the human player operating the input section J2 (or mode selection switch). In the case where the mode setting information referred to is indicative of the "quality priority mode", the rendition style synthesis section J3 uses a joint-portion rendition style module alone, while, in the case where the mode setting information referred to is indicative of the "tone generation priority mode", the rendition style synthesis section J3 uses a tail-portion rendition style module in combination with a note preceding a joint portion in question and a head-portion rendition style module in combination with a note succeeding the joint portion. Further, in the case where the mode setting information referred to is indicative of the "tone generation priority mode", not only information specifying the individual rendition style modules but also information for processing these rendition style modules is preferably added to the "rendition style information". Processing of the rendition style modules will be detailed later with primary reference to FIGS. 5-6. On the basis of the "rendition style information" generated by the rendition style synthesis section J3, the tone synthesis section J4 reads out waveform data to be used from the database J1, then processes the read-out waveform data as necessary to synthesize a tone, and output the tone. Namely, the tone synthesis section J4 performs tone synthesis while appropriately switching between waveform data in accordance with the generated "rendition style information".

Figure 3:
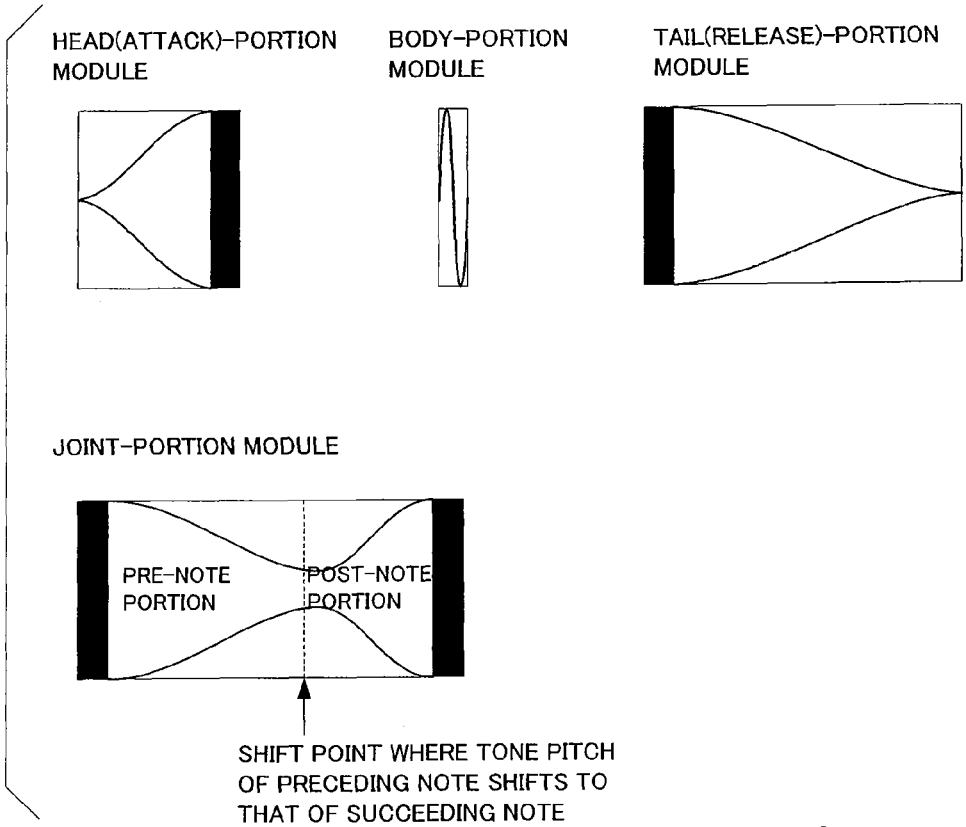
FIG. 3 is a conceptual diagram showing examples of rendition style modules.

In the database (waveform memory) J1, there are prestored, as "rendition style modules", a multiplicity of sets of original rendition style waveform data and data (i.e., rendition style parameters) related thereto. Each of the "rendition style modules" is a unit rendition style waveform processable in a rendition style synthesis system as a single block. In other words, each of the "rendition style modules" is a unit rendition style waveform processable as a single event. Next, with reference to FIG. 3, a description will be given about the rendition style modules stored in the above-mentioned database (waveform memory) J1. FIG. 3 is a conceptual diagram showing examples of the rendition style modules. In FIG. 3, there are shown only envelopes of waveforms represented by rendition style waveform data.

As seen from FIG. 3, among rendition style waveform data of various rendition style modules are those each defined in correspondence with a partial portion, such as a head, body or tail portion, of a note in accordance with, for example, a rendition style characteristic of a performance tone (i.e., head-portion, body-portion and tail-portion rendition style modules), and those each defined in correspondence with a joint portion between adjoining notes (i.e., joint-portion rendition style modules). Such rendition style modules can be classified into several major types on the basis of characteristics of the rendition styles, temporal segments or sections of performances, etc. For example, the following are five major types of rendition style modules classified in the instant embodiment:

1) "Normal Head Module": This is a head-type or head-portion rendition style module representative of (and hence applicable to) a rise portion (i.e., "attack" portion) of a tone from a silent state;

2) "Normal Tail Module": This is a joint-related (or tail-type or tail-portion) rendition style module representative of (and hence applicable to) a fall portion (i.e., "release" portion) of a tone to a silent state;

3) "Normal Joint Module": This is a joint-related (or joint-type or joint-portion) rendition style module representative of (and hence applicable to) a joint portion connecting between two successive notes by a legato (slur) with no intervening silent state;

4) "Normal Body Module": This is a body-related (or body-type) rendition style module representative of (and hence applicable to) a steady (body) portion of a tone in between rise and fall-portions of the tone;

5) "Joint Head Module": This is a head-related rendition style module representative of (and hence applicable to) a rise portion of a tone realizing a tonguing rendition style that is a special kind of rendition style unlike the above-mentioned normal head module.

Here, the "tonguing rendition style" is a rendition style characteristic of a performance of a wind instrument, such as a saxophone, with which one tone is change to another by a human player changing playing fingers the moment the human player cuts the one tone by temporarily closing the mouthpiece of the saxophone with his or her tongue; thus, the tones are sounded with a moment's pause. Among playing actions similar to the tonguing is a bowing direction change used in a performance of a stringed instrument, such as a violin. Thus, the term "tonguing rendition style" is used herein to refer to any one of various rendition styles including musical expressions sounded with a moment's pause as by a bowing direction change.

It should be appreciated here that the classification into the above five rendition style module types is just illustrative, and the classification of the rendition style modules may of course be made in any other suitable manner; for example, the rendition style modules may be classified into more than the five types. Further, needless to say, the rendition style modules may also be classified per original tone source, such as the human player, type of musical instrument or performance genre.

Further, in the instant embodiment, each set of rendition style waveform data, corresponding to one rendition style module, is stored in a database as a data set of a plurality of waveform-constituting factors or elements, rather than being stored merely as originally input; each of the waveform-constituting elements will hereinafter be called a vector. As an example, each rendition style module includes the following vectors. Note that "harmonic" and "nonharmonic" components are defined here by separating an original rendition style waveform in question into a waveform segment having a pitch-harmonic component (harmonic component) and the remaining waveform segment having a non-pitch-harmonic component (nonharmonic component).

1) Waveform shape (timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope (temporal amplitude variation characteristic) extracted from among the waveform-constituting elements of the harmonic component.

3) Pitch vector of the harmonic component: This vector represents a characteristic of a pitch extracted from among the waveform-constituting elements of the harmonic component; for example, it represents a characteristic of temporal pitch variation relative to a given reference pitch.

4) Waveform shape (timbre) vector of the nonharmonic component: This vector represents only a characteristic of a waveform shape (noise-like waveform shape) extracted from among the waveform-constituting elements of the nonharmonic component and normalized in amplitude.

5) Amplitude vector of the nonharmonic component: This vector represents a characteristic of an amplitude envelope extracted from among the waveform-constituting elements of the nonharmonic component.

The rendition style waveform data of the rendition style module may include one or more other types of vectors, such as a time vector indicative of a time-axial progression of the waveform, although not specifically described here.

For synthesis of a rendition style waveform, waveforms or envelopes corresponding to various constituent elements of the rendition style waveform are constructed along a reproduction time axis of a performance tone, and predetermined waveform synthesis processing is performed on the basis of the individual vector data arranged on or allotted to the time axis to thereby generate a rendition waveform. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments. Further, in the present invention, if instructed to use a tail-portion rendition module and head-portion rendition module rather than a joint-portion rendition module in synthesizing a tone of a joint portion, the respective vector data of the tail-portion rendition module and head-portion rendition module are modified as necessary so that the tone is synthesized with an appropriately processed waveform, as will be later described.

The data (rendition style parameters) stored in the database J1 together with each of the waveform data sets include a dynamics value and pitch information of the corresponding original waveform data, a crossfade time length to be used in tone length, etc. In the illustrated example, such data are collectively managed as a data table. The rendition style parameters are parameters for controlling the time length and level of the waveform of the rendition style module, and may include one or more kinds of parameters determined depending on the nature of the rendition style module. For example, the "normal head module" or "joint head module" may include different kinds of rendition style parameters, such as an absolute tone pitch and tone volume immediately after the beginning of generation of a tone, the "normal body module" may include different kinds of rendition style parameters, such as an absolute tone pitch of the rendition style module, start and end times of the normal body and dynamics at the beginning and end of the normal body. These rendition style parameters may be prestored in the waveform memory or the like, or may be entered by user's input operation. The exist rendition style parameters may be modified via user operation as necessary. Further, in a situation where no rendition style parameter is given at the time of reproduction of a rendition style waveform, predetermined standard rendition style parameters may be automatically imparted. Furthermore, suitable parameters may be automatically produced and imparted in the course of processing.

Next, with reference to FIG. 4, a description will be given about processing for synthesizing a tone of a joint portion. FIG. 4 is a flow chart showing an example of the "joint-portion tone synthesis processing". Note that waveforms of head and body portions of a preceding note has already been generated through not-shown tone synthesis processing prior to the joint-portion tone synthesis processing. Thus, by the joint-portion tone synthesis processing being performed following the tone synthesis of the head and body portions, a tone of the joint portion connecting between the preceding and succeeding notes with no break of tone can be synthesized following the body portion of the preceding note.

At step S1, a determination is made as to whether or not note-on information has been acquired. The operation of step S1 is repeated until note-on information has been acquired (i.e., as long as a NO determination is made at step S1). Once note-on information has been acquire (i.e., upon a YES determination at step S1), a detection is made, at step S2, of an overlap between tone generating times of the currently-sounded preceding note and the succeeding note for which the start of sounding (i.e., tone generation) has been instructed on the basis of the acquired note-on information. Namely, a detection is made of (1) a state where note-on information instructing the start of tone generation (sounding) of the succeeding note has been acquired after acquisition of note-off information instructing the end of tone generation (sounding) of the preceding note so that the preceding and succeeding notes are not sounded in a temporally overlapping manner (i.e., state where the preceding and succeeding notes do not overlap with each other and which does not correspond to a legato rendition style), or (2) a state where note-on information instructing the start of tone generation of the succeeding note has been acquired before acquisition of note-off information instructing the end of tone generation (sounding) of the preceding note so that the preceding and succeeding notes are sounded in a temporally overlapping manner (i.e., state where the preceding and succeeding notes overlap with each other and which corresponds to a legato rendition style). At next step S3, it is determined whether or not what is currently instructed is the state where the preceding and succeeding notes overlap with each other, i.e. whether a legato rendition style is currently instructed.

If it has been determined that what is currently instructed is not the state where the preceding and succeeding notes overlap with each other, i.e. not a legato rendition style (NO determination at step S3), the processing goes to step S8 to generate rendition style information instructing that a normal head module (or joint head module) be used so that separate waveforms are synthesized as the preceding and succeeding notes instead of a single continuous waveform being synthesized as the preceding and succeeding notes. At step S9, a tone is synthesized in accordance with the generated rendition style information.

Namely, in this case, respective waveforms of the preceding and succeeding notes are synthesized separately as with the conventional techniques. In other words, the normal head module (or joint head module) is merely subjected to a process for pitch-shifting the entire waveform on the basis of the note-on information. If note-off information of the preceding note has been received prior to receipt of note-on information of the succeeding note and the preceding note has been processed using a tail module, the tail module of the preceding note and the above-mentioned normal head module are not subjected to waveform processing (to be later described with reference to FIGS. 5 and 6) reflecting therein tone pitches, amplitudes, etc. of the preceding and succeeding notes. Determination as to which of the normal head module and joint head module should be used may be made automatically in accordance with a detected time length from the note-off time of the preceding note to the note-on time of the succeeding note.

If it has been determined that what is currently instructed is the state where the preceding and succeeding notes overlap with each other, i.e. a legato rendition style (YES determination at step S3), the processing goes to step S4 where a further determination is made, with reference to the mode setting information currently stored in the parameter storage section J5, as to whether the currently-stored mode setting information is the one for setting the "tone generation priority mode". If the currently-stored mode setting information is the one for setting the "quality priority mode" rather than the "tone generation priority mode" (NO determination at step S4), rendition style information instructing that a normal joint module be used (selected) is generated at step S7. Tone is synthesized in accordance with the generated rendition style information (i.e., selected normal joint module. In the case where the normal joint module is used for tone synthesis of the joint portion, there would be caused an undesired auditory tone generating delay (i.e., latency) from the note-on instruction of the succeeding note to the time point when sounding of the succeeding note can start to be heard, as discussed above in relation to the prior art, although tones achieving a legato rendition style connecting between the preceding and succeeding notes with no break of tone can be synthesized with a high quality. Thus, the "quality priority mode" can be said to be a mode capable of synthesizing high-quality tones at the sacrifice of a latency by using a normal joint module for synthesis of a tone of a joint portion as in the prior art.

If the currently-stored mode setting information is the one for setting the "tone generation priority mode" (YES determination at step S4), rendition style information instructing that a normal tail module for ending the waveform of the preceding note be used (selected) is generated for the preceding note while rendition style information instructing that a joint head module for starting a waveform of the succeeding note be used (selected) is generated for the succeeding note, at step S5. Namely, in this case too, the preceding and succeeding notes are synthesized as separate or independent waveforms. However, in this case, information pertaining to the waveform processing reflecting therein tone pitches, amplitudes, etc. of the preceding and succeeding notes is added to the individual generated rendition style information so that such waveform processing is performed on the selected normal tail module and joint head module, at step S6. At step S9, a tone is synthesized in accordance with the generated rendition style information (i.e., selected normal tail module and joint head module).

The above-mentioned waveform processing includes, for example, modifying the respective amplitude vectors, pitch vectors, waveform shape vectors and time positions of the selected normal tail module and joint head module in accordance with anteroposterior relationship, such as a tone pitch difference and tone volume difference, between the preceding and succeeding notes. In this way, the instant embodiment can prevent tone quality (synthesis quality) from being degraded as compared to the case where the normal joint module is used. Therefore, the "tone generation priority mode" in the instant embodiment can be said to be a nonconventional or novel mode which not only can achieve an improved latency but also can synthesize tones without quality degradation by using a normal tail module and joint head module, rather than a normal joint module, for synthesis of a tone of a joint portion and by appropriately processing these modules in accordance with anteroposterior relationship between preceding and succeeding notes. Further, because the normal tail module and joint head module are used after being subjected to the appropriate processing, these data can be used on various occasions, so that it is possible to prevent an increase in the necessary capacity of the database for storing rendition style modules.

In the aforementioned "tone generation priority mode", it is possible to reduce a tone generating delay (latency) as compared to the case where the normal joint module is used, because tone generation processing is independently performed on the succeeding note in accordance with sounding of the joint head module without being affected by sounding of the preceding note (i.e., without a need to perform an operation for connecting the succeeding note, which is to be sounded now, to the currently-sounded preceding note) and because no time is required for a tone pitch transition as required in the case where the normal joint module is used. However, in the case where the normal tail module and joint head module are used to synthesize a tone of the joint portion, the preceding and succeeding notes are synthesized as independent waveforms, rather than as a single continuous waveform, as set forth above, so that a tone pitch transition tends to be rather abrupt as compared in the case where the normal joint module is used and thus the two tones can hardly be heard as legato tones due to an unsmooth connection between the tones. Thus, in order to avoid such an inconvenience to permit a smooth tone pitch transition from the preceding note to the succeeding note so that the two tones can be heard as legato tones, the aforementioned joint-portion tone synthesis processing is arranged to synthesize a tone after performing the waveform processing, such as changing the respective vectors of the selected normal tail module and joint head module in accordance with anteroposterior relationship between the preceding and succeeding notes and adjusting the time positions of the modules. One example of the waveform processing will be detailed below.

Figure 5A:
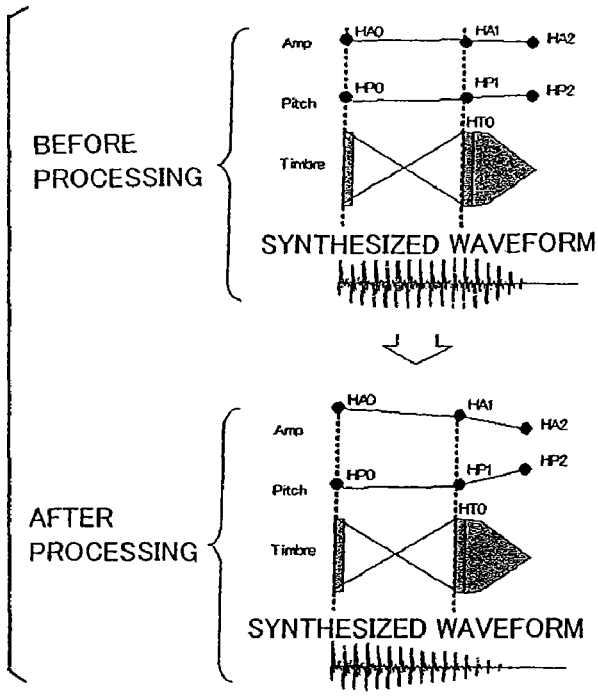
FIG. 5A is a conceptual diagram schematically explanatory of waveform processing by vector modification, which particularly shows example manners in which individual vectors of a normal tail module are modified.
Figure 5B:
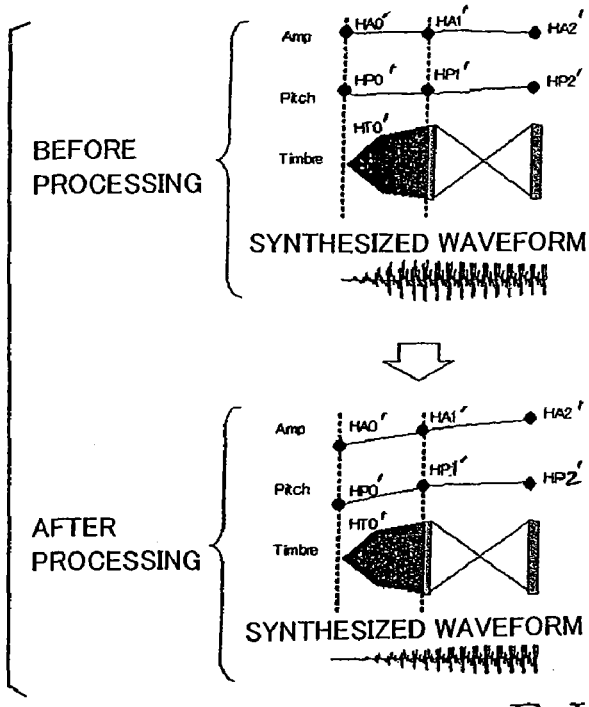
FIG. 5B is a conceptual diagram schematically explanatory of waveform processing by vector modification, which particularly shows example manners in which individual vectors of a joint head module are modified.

Modification operations of the amplitude vector and pitch vector of the normal tail module and joint head module and adjustment of time positions of the modules (see step S6 of FIG. 4) will now be described with reference to FIGS. 5 and 6. FIGS. 5A and 5B are conceptual diagrams schematically explanatory of the waveform processing by the vector modification. More specifically, FIG. 5A shows an example manner in which the amplitude vector and pitch vector of the normal tail module are modified, while FIG. 5B shows an example manner in which the amplitude vector and pitch vector of the joint head module are modified. Upper section of each of FIGS. 5A and 5B shows the individual vectors before the waveform processing, while a lower section of each of FIGS. 5A and 5B shows the individual vectors after the waveform processing. In the figures, "HA" represents a train of values at representative points (e.g., three representative points "0", "1" and "2") (namely, representative point values at points "0", "1" and "2") of the amplitude vector of the harmonic component, "HP" represents a train of values at representative points (e.g., three representative points "0", "1" and "2") of the pitch vector of the harmonic component, and "HT" represents an example of the waveform shape vector of the harmonic component (here, the waveform shape is represented by its envelope alone). FIGS. 5A and 5B show examples of the individual vectors of the harmonic component, and illustration and description of examples of the individual vectors of the nonharmonic component are omitted here. Further, other representative point value trains than those illustrated in the figures may be employed.

For the amplitude vector of the normal tail module, as shown in FIG. 5A, the amplitude value at representative point "HA2" is lowered as compared to that before the waveform processing, to thereby modify an amplitude curve extending from representative point "HA1" to representative point "HA2" into a downward-sloping curve. Thus, the preceding note is caused to fade out during the tone synthesis in accordance with the modified amplitude curve. On the other hand, for the amplitude vector of the joint head module, as shown in FIG. 5B, the amplitude value at representative point "HA0'" is lowered as compared to that before the waveform processing, to thereby modify an amplitude curve extending from representative point "HA0'" to representative point "HA1'" into an upward-sloping curve. Thus, the succeeding note is caused to fade in during the tone synthesis in accordance with the modified amplitude curve. Namely, because the instant embodiment is arranged, for the tone synthesis of the joint portion, to separately synthesize respective tones (waveforms) of the preceding and succeeding notes with the normal tail module and joint head module temporally overlapped with each other, there is a need to consider influences which the tone synthesis performed with normal tail module and joint head module temporally overlapped with each other imparts to the tones. Therefore, the instant embodiment modifies the respective amplitude vectors so as to cause the amplitude of the preceding note to fade out and cause the amplitude of the succeeding note to fade in an overlapping range where the preceding and succeeding notes are sounded simultaneously. Amounts of such amplitude vector modification may be determined on the basis of respective performance information of the preceding and succeeding notes acquired and stored in advance; for example, the modification amounts may be determined reflecting a tone volume difference between the preceding and succeeding notes. The amplitude vectors are preferably modified in such a manner that the amplitude curve extending from representative point "HA1" to representative point "HA2" in the amplitude vector of the normal tail module and the amplitude curve extending from representative point "HA0'" to representative point "HA1'" in the amplitude vector of the joint head module have symmetrical relationship with respect to a predetermined time axis, although the present invention is not necessarily so limited.

Further, for the pitch vector of the normal tail module, as shown in FIG. 6A, the pitch vector value at representative point "HP2" is changed as compared to that before the waveform processing, to thereby modify a pitch curve extending from representative point "HP1" to representative point "HP2" into an upward-sloping curve (provided that the tone pitch of the succeeding note is higher than that of the preceding note). On the other hand, for the amplitude vector of the joint head module, as shown in FIG. 5B, the pitch vector value at representative point "HP0'" is changed as compared to that before the waveform processing, to thereby modify a pitch curve extending from representative point "HP0'" to representative point "HP1'" into an upward-sloping curve. Namely, the respective pitch vectors of the normal tail module and joint head module are modified so as to add pitch curves such that a transition occurs from the tone pitch of the preceding note to the tone pitch of the succeeding note. Amounts of such pitch vector modification may be determined on the basis of respective performance information of the preceding and succeeding notes acquired and stored in advance, as in the case of the amplitude vector modification; for example, the amounts of the modification may be determined reflecting a tone pitch difference between the preceding and succeeding notes. Namely, the instant embodiment changes parts (rendition style parameters) of the amplitude and pitch vectors so as to appropriately modify the amplitude and pitch curves of prestored original waveforms, to thereby adjust overlapping conditions (more specifically, amplitude and tone pitch transitions) between the preceding and succeeding notes. In this way, the tonal connection from the preceding note to the succeeding note can be improved so that tones in the overlapping range between the preceding and succeeding notes can be heard more like legato tones as the two notes are sounded.

Figure 6:
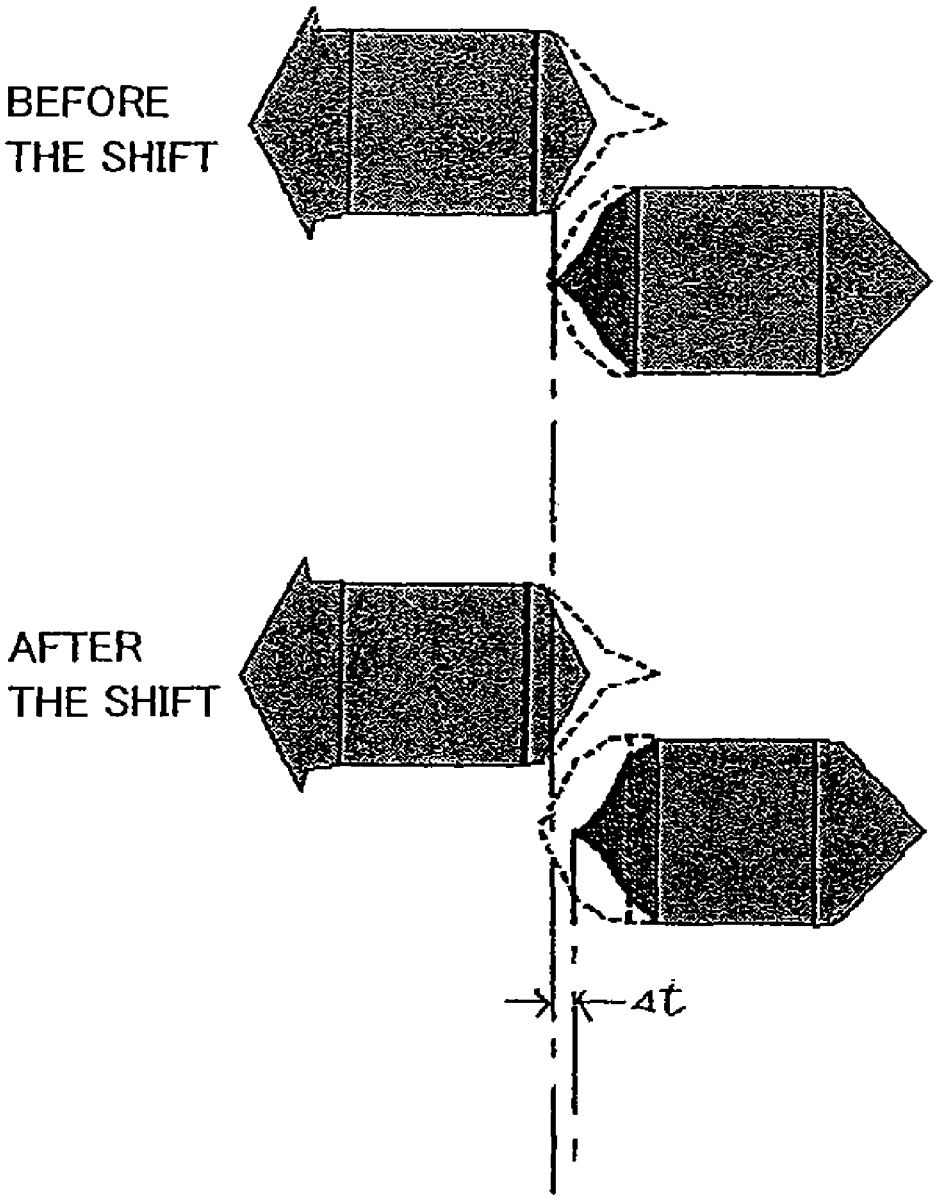
FIG. 6 is a conceptual diagram schematically explanatory of waveform processing by time position adjustment of the joint head module.

FIG. 6 is a conceptual diagram schematically explanatory of the waveform processing by the time position adjustment of the joint head module. Upper section of FIG. 6 shows the joint head module before the time position adjustment, while a lower section of each of FIG. 6 shows the joint head module after the waveform processing. In the figure, dotted lines depict waveforms before the aforementioned waveform processing by the amplitude vector modification, while solid lines depict waveforms after the aforementioned waveform processing by the amplitude vector modification. Whereas the joint head module to be used for the succeeding note is ordinarily allotted to a time position such that tone synthesis of the module is started substantially simultaneously with receipt of the note-on information of the succeeding note, the instant embodiment of the invention is arranged to perform control for delaying, through operation of a delay control section, the synthesis start timing of the succeeding note behind the note-on timing (i.e., timing to instruct the start of tone generation) of the succeeding note. Namely, once a predetermined condition according to a tone pitch difference, tone volume difference and/or the like between the preceding and succeeding notes is satisfied, the delay control section shifts the time position of the joint head module so that tone synthesis of the joint head module to be used for the succeeding tone is started a predetermined delay time (i.e., time shift amount) $\Delta t$ after the receipt of the note-on information of the succeeding note, instead of being positioned at such a time position that the tone synthesis of the joint head module to be used for the succeeding tone is started substantially simultaneously with the receipt of the note-on information of the succeeding note. Thus, once a predetermined condition, e.g. condition that the tone pitch difference or tone volume difference between the preceding and succeeding notes is great, is satisfied, the start of tone generation of the succeeding note is slightly delayed, so that the tone pitch or tone volume change from the preceding note to the succeeding note can be made moderate and thus a smooth shift from the preceding note to the succeeding note is permitted in the joint portion. The process corresponding to the operation of the delay control section may be performed at step S6 (processing step) or at step S9 (tone synthesis step) of FIG. 4; alternatively, the delay control step may be inserted between steps S6 and S9. Note that the delay time $\Delta t$ may be of either a fixed value or variable value. For example, the delay time $\Delta t$ may be of a value differing in accordance with the tone pitch difference or tone volume difference between the preceding and succeeding notes.

Note that the waveform processing may be performed on only one of the normal tail module and joint head module with reference to the performance information of not only the note in question but also another note (preceding or succeeding note). Further, whereas the preferred embodiment of the present invention has been described above in relation to the case where, in modifying the amplitude vectors and pitch vectors of the normal tail module and joint head module, the waveform processing is performed by changing only one of the representative points of the succeeding note (HA2 and HP2) or of the preceding note (HA0' and HP0') of each of the vectors, the present invention is not so limited; for example, the waveform processing may be performed by changing a plurality of representative points close to the succeeding note or preceding note. Namely, in the illustrated examples of FIG. 5, two representative points of each of the vectors, i.e. HA2 and HA1; HP2 and HP1; HA0' and HA1'; and HP0' and HP1'. Further, previously-prepared other amplitude and pitch vectors than the original amplitude and pitch vectors may be used in place of the original amplitude and pitch vectors, i.e. the original amplitude vector and pitch vector may be replaced in their entirety with the previously-prepared other amplitude vector and pitch vector.

Further, vector modification amounts and time shift amounts corresponding to a tone pitch difference and/or tone volume difference between the preceding note and succeeding note may be preset so that the modification of the individual vectors of the normal tail module and joint head module and the time position adjustment of the individual modules is performed in accordance with the preset vector modification amounts and time shift amounts. Furthermore, the vector modification amounts and time shift amounts may be appropriately set by the user in correspondence with a tone pitch difference and/or tone volume difference between the preceding note and succeeding note.

Furthermore, the individual vectors may be modified in accordance with predetermined modification amounts corresponding to the type of the musical instrument used so that the amplitude curve and pitch curve after the vector modification differ differently per musical instrument type. Furthermore, the amplitude curve and pitch curve may be modified by predetermined modification amounts in response to a key scale and/or touch scale rather than a tone pitch difference or tone volume difference.

In order to enhance tone quality (synthesis quality), it is only necessary that pre-note portions of normal joint modules each for realizing a legato rendition style be prestored as waveform shape vector data of normal tail modules and that post-note portions of normal joint modules each for realizing a legato rendition style be prestored as waveform shape vector data of joint head modules.

It should be appreciated that the waveform data employed in the present invention may be of any desired type without being limited to those constructed as rendition style modules in correspondence with various rendition styles as described above. Further, needless to say, the waveform data of the individual modules may be either data that can be generated by merely reading out waveform sample data based on a suitable coding scheme, such as the PCM, DPCM or ADPCM, or data generated using any one of the various conventionally-known tone waveform synthesis methods, such as the harmonics synthesis operation, FM operation, AM operation, filter operation, formant synthesis operation and physical model tone generator methods. Namely, the tone generator 8 in the present invention may employ any of the known tone signal generation methods such as: the memory readout method where tone waveform sample value data stored in a waveform memory are sequentially read out in accordance with address data varying in response to the pitch of a tone to be generated; the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Namely, the tone signal generation method employed in the tone generator 8 may be any one of the waveform memory method, FM method, physical model method, harmonics synthesis method, formant synthesis method, analog synthesizer method using a combination of VCO, VCF and VCA, analog simulation method, and the like. Further, instead of constructing the tone generator 8 using dedicated hardware, the tone generator circuitry 8 may be constructed using a combination of the DSP and microprograms or a combination of the CPU and software. Furthermore, a plurality of tone generation channels may be implemented either by using a single or common circuit on a time-divisional basis or by providing a separate dedicated circuit for each of the channels.

Further, the tone synthesis method in the above-described tone synthesis processing may be either the so-called playback method where existing performance information is acquired in advance prior to arrival of original performance timing and a tone is synthesized by analyzing the thus-acquired performance information, or the real-time method where a tone is synthesized on the basis of performance information supplied in real time.

Note that, even in cases where the preceding note and succeeding note do not overlap with each other, i.e. the end of tone generation of the preceding note and the start of tone generation of the succeeding note are temporally separated from each other (namely, note-on information of the succeeding note is acquired before note-off information of the preceding note) so that tone synthesis is performed independently for each of the preceding note and succeeding note, waveform processing may be performed for a tone rise (i.e., head) portion of the succeeding note by appropriately modifying the amplitude vector and pitch vector of a head-portion rendition style module to be used for the succeeding note on the basis of relationship with the preceding note.

Furthermore, in the case where the above-described tone synthesis apparatus of the present invention is applied to an electronic musical instrument, the electronic musical instrument may be of any type other than the keyboard instrument type, such as a stringed, wind or percussion instrument type. The present invention is of course applicable not only to the type of electronic musical instrument where all of the performance operator unit, display, tone generator, etc. are incorporated together within the body of the electronic musical instrument, but also to another type of electronic musical instrument where the above-mentioned components are provided separately and interconnected via communication facilities such as a MIDI interface, various networks and/or the like. Further, the tone synthesis apparatus of the present invention may be implemented with a combination of a personal computer and application software, in which case various processing programs may be supplied to the tone synthesis apparatus from a storage medium, such as a magnetic disk, optical disk or semiconductor memory, or via a communication network. Furthermore, the tone synthesis apparatus of the present invention may be applied to automatic performance apparatus, such as karaoke apparatus and player pianos, game apparatus, and portable communication terminals, such as portable telephones. Further, in the case where the tone synthesis apparatus of the present invention is applied to a portable communication terminal, part of the functions of the portable communication terminal may be performed by a server computer so that the necessary functions can be performed cooperatively by the portable communication terminal and server computer. Namely, the tone synthesis apparatus of the present invention may be arranged in any desired manner as long as it can use predetermined software or hardware, constructed in accordance with the basic principles of the present invention, to appropriately switch, in response to mode selection, between rendition style modules for use in synthesis of a tone of a joint portion and to, when the tone generation priority mode is selected, synthesize a tone after processing the rendition style module in accordance with anteroposterior relationship between adjoining notes.

The invention claimed is:

1. A tone synthesis apparatus comprising:

a storage section that stores therein at least head-portion waveform data corresponding to a rise portion of a tone, tail-portion waveform data corresponding to a fall portion of a tone and joint-portion waveform data corresponding to a joint portion connecting between two successive notes;

a mode setting section that sets either one of a tone generation priority mode and a quality priority mode, wherein the tone generation priority mode and the quality priority mode are modes to be selectively used in order to synthesize a connecting tone for connecting between two successive notes, the tone generation priority mode being intended to reduce a delay in tone generation timing of a succeeding one of the two successive notes as compared to the quality priority mode;

an acquisition section that acquires performance information;

a data selection section that, when a connecting tone for connecting between two successive notes is to be generated in accordance with the acquired performance information, selects the joint-portion waveform data from said storage section if a mode currently set by said mode setting section is the quality priority mode, but selects the head-portion waveform data and the tail-portion waveform data from said storage section if the currently-set mode is the tone generation priority mode;

a data processing section that, when the currently-set mode is the tone generation priority mode, processes at least one of a pitch and amplitude of at least one of the head-portion waveform data and tail-portion waveform data selected by said data selection section, on the basis of the acquired performance information, so as to provide a smoothly-varying connecting tone; and a tone synthesis section that synthesizes a tone on the basis of the waveform data read out from said storage section in response to selection by said data selection section and in accordance with processing by said data processing section, wherein, when the currently-set mode is the tone generation priority mode, said tone synthesis section separately synthesizes, in accordance with the processing by said data processing section, a tone of a fall portion of a temporally preceding one of two successive notes on the basis of the tail-portion waveform data read out from said storage section and a tone of a rise portion of a temporally succeeding one of the two successive notes on the basis of the head-portion waveform data read out from said storage section, so that a connecting tone is realized by a combination of the synthesized tone of the fall portion of the preceding note and the synthesized tone of the rise portion of the succeeding note.

2. The tone synthesis apparatus as claimed in claim 1 wherein said storage section stores, along with the head-portion waveform data and tail-portion waveform data extracted from an original waveform, temporal pitch variation and/or amplitude variation of the original waveform for each of the portions, and wherein said data processing section performs at least one of first and second processing, wherein the first processing obtains a tone pitch difference and/or tone volume difference of the succeeding note from the preceding note with reference to performance information of the succeeding note and modifies the stored pitch variation and/or amplitude variation of the tail portion on the basis of the obtained tone pitch difference and/or tone volume difference, and the second processing obtains a tone pitch difference and/or tone volume difference of the preceding note from the succeeding note with reference to performance information of the preceding note and modifies the stored pitch variation and/or amplitude variation of the head portion on the basis of the obtained tone pitch difference and/or tone volume difference.

3. The tone synthesis apparatus as claimed in claim 1 wherein said storage section stores, as the tail-portion waveform data, data of a waveform preceding a predetermined division point of an original waveform, having at least two successive notes, where a shift occurs between preceding and succeeding ones of the successive notes.

4. The tone synthesis apparatus as claimed in claim 1 wherein said storage section stores, as the head-portion waveform data, data of a waveform succeeding a predetermined division point of an original waveform, having at least two successive notes, where a shift occurs between preceding and succeeding ones of the successive notes.

5. The tone synthesis apparatus as claimed in claim 1 which further comprises a delay control section that, when the currently-set mode is the tone generation priority mode, performs control to delay synthesis start timing of the waveform data of the succeeding note behind tone generation start instructing timing of the succeeding note.

6. The tone synthesis apparatus as claimed in claim 5 wherein said delay control section determines a delay time of the synthesis start timing relative to the tone generation start instructing timing of the succeeding note in accordance with a tone pitch difference or tone volume difference between the preceding note and the succeeding note.

7. The tone synthesis apparatus as claimed in claim 1 which further comprises a determination section that determines, on the basis of the acquired performance information, whether or not two successive performance notes are to be performed in a legato rendition style, and wherein, when said determination section has determined that the two successive performance notes are to be performed in a legato rendition style, said data selection section selects the joint-portion waveform data or the head-portion and tail-portion waveform data in order to generate a connecting tone for connecting between the two successive notes.

8. A tone synthesis method implementable by a computer using a memory stores therein at least head-portion waveform data corresponding to a rise portion of a tone, tail-portion waveform data corresponding to a fall portion of a tone and joint-portion waveform data corresponding to a joint portion connecting between two successive notes, said tone synthesis method comprising:

a setting step of setting either one of a tone generation priority mode and a quality priority mode, wherein the tone generation priority mode and the quality priority mode are modes to be selectively used in order to synthesize a connecting tone for connecting between two successive notes, the tone generation priority mode being intended to reduce a delay in tone generation timing of a succeeding one of the two successive notes as compared to the quality priority mode;

a step of acquiring performance information;

a selection step of, when a connecting tone for connecting between two successive notes is to be generated in accordance with the acquired performance information, selecting the joint-portion waveform data from the memory if the mode currently set by said setting step is the quality priority mode, but selecting the head-portion waveform data and the tail-portion waveform data from the memory if the currently-set mode is the tone generation priority mode;

a processing step of, when the currently-set mode is the tone generation priority mode, processing at least one of a pitch and amplitude of at least one of the head-portion waveform data and tail-portion waveform data selected by said selection step, on the basis of the acquired performance information, so as to provide a smoothly-varying connecting tone; and a synthesis step of synthesizing a tone on the basis of the waveform data read out from the memory in response to selection by said selection step and in accordance with processing by said processing step, wherein, when the currently-set mode is the tone generation priority mode, said synthesis step separately synthesizes, in accordance with the processing by said processing step, a tone of a fall portion of a temporally preceding one of two successive notes on the basis of the tail-portion waveform data read out from the memory and a tone of a rise portion of a temporally succeeding one of the successive notes on the basis of the head-portion waveform data read out from the memory, so that a connecting tone is realized by a combination of the synthesized tone of the fall portion of the preceding note and the synthesized tone of the rise portion of the succeeding note.

9. The tone synthesis method as claimed in claim 8 which further comprises a step of, when the currently-set mode is the tone generation priority mode, performing control to delay synthesis start timing of the waveform data of the succeeding note behind tone generation start instructing timing of the succeeding note.

10. A computer-readable storage medium containing a program for causing a computer to perform a tone synthesis procedure using a memory stores therein at least head-portion waveform data corresponding to a rise portion of a tone, tail-portion waveform data corresponding to a fall portion of a tone and joint-portion waveform data corresponding to a joint portion connecting between two successive notes, said tone synthesis procedure comprising:

a setting step of setting either one of a tone generation priority mode and a quality priority mode, wherein the tone generation priority mode and the quality priority mode are modes to be selectively used in order to synthesize a connecting tone for connecting between two successive notes, the tone generation priority mode being intended to reduce a delay in tone generation timing of a succeeding one of the two successive notes as compared to the quality priority mode;

a step of acquiring performance information;

a selection step of, when a connecting tone for connecting between two successive notes is to be generated in accordance with the acquired performance information, selecting the joint-portion waveform data from the memory if the mode currently set by said setting step is the quality priority mode, but selecting the head-portion waveform data and the tail-portion waveform data from the memory if the currently-set mode is the tone generation priority mode;

a processing step of, when the currently-set mode is the tone generation priority mode, processing at least one of a pitch and amplitude of at least one of the head-portion waveform data and tail-portion waveform data selected by said selection step, on the basis of the acquired performance information, so as to provide a smoothly-varying connecting tone; and a synthesis step of synthesizing a tone on the basis of the waveform data read out from the memory in response to selection by said selection step and in accordance with processing by said processing step, wherein, when the currently-set mode is the tone generation priority mode, said synthesis step separately synthesizes, in accordance with the processing by said processing step, a tone of a fall portion of a temporally preceding one of two successive notes on the basis of the tail-portion waveform data read out from the memory and a tone of a rise portion of a temporally succeeding one of the successive notes on the basis of the head-portion waveform data read out from the memory, so that a connecting tone is realized by a combination of the synthesized tone of the fall portion of the preceding note and the synthesized tone of the rise portion of the succeeding note.

11. The computer-readable storage medium as claimed in claim 10 which further comprises a step of, when the currently-set mode is the tone generation priority mode, performing control to delay synthesis start timing of the waveform data of the succeeding note behind tone generation start instructing timing of the succeeding note.

* * * * *